US009877362B2

(12) United States Patent
Kang

(10) Patent No.: US 9,877,362 B2
(45) Date of Patent: Jan. 23, 2018

(54) LIGHT EMITTING DIODE DRIVER CIRCUIT, DISPLAY APPARATUS INCLUDING THE SAME, AND METHOD FOR DRIVING LIGHT EMITTING DIODE

(71) Applicant: SAMSUNG ELECTRONICS CO., LTD., Suwon-si (KR)

(72) Inventor: Jeong-il Kang, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 15/095,862

(22) Filed: Apr. 11, 2016

(65) Prior Publication Data

US 2016/0309554 A1 Oct. 20, 2016

(30) Foreign Application Priority Data

Apr. 20, 2015 (KR) ..... 10-2015-0055458

(51) Int. Cl.
*H05B 33/08* (2006.01)
*G09G 3/36* (2006.01)
*G09G 3/34* (2006.01)

(52) U.S. Cl.
CPC ..... *H05B 33/0815* (2013.01); *G09G 3/3406* (2013.01); *G09G 3/36* (2013.01); *G09G 2320/0626* (2013.01)

(58) Field of Classification Search
CPC .. H05B 33/0815; H05B 39/02; G09G 3/3406; G09G 3/36; G09G 2320/0626; G09G 2320/064; G09G 2320/0646; H02J 7/007
See application file for complete search history.

(56) References Cited

U.S. PATENT DOCUMENTS 8,013,830 B2 * 9/2011 Hsu ..... G09G 3/342 345/102
8,605,123 B2 * 12/2013 Oh ..... G09G 3/3426 345/690
9,183,788 B2 * 11/2015 Zhang ..... G09G 3/3406
9,418,611 B2 * 8/2016 Tuikkanen ..... G09G 3/342
2008/0136343 A1 * 6/2008 Yu ..... H05B 41/3925 315/219
2008/0143757 A1 * 6/2008 Furihata ..... G09G 3/3406 345/690
2009/0236997 A1 * 9/2009 Liu ..... A01M 29/10 315/209 R
2010/0164394 A1 * 7/2010 Liu ..... H05B 33/0818 315/287
2010/0213857 A1 * 8/2010 Fan ..... H05B 33/0827 315/186
2010/0259511 A1 * 10/2010 Kimura ..... G06F 21/84 345/204

(Continued)

*Primary Examiner* — Tom Sheng
(74) *Attorney, Agent, or Firm* — Sughrue Mion, PLLC

(57) ABSTRACT

A light emitting diode (LED) driver circuit is provided. The light emitting diode (LED) driver circuit includes an LED array; an LED driving circuit configured to provide a constant current to the LED array by a switching operation of a switch element; and a driving controller configured to control the switch element using a clock signal of a preset frequency so that the constant current corresponding to a dimming signal is provided to the LED array. The driving controller varies a frequency of the clock signal in response to a signal value indicating that the dimming signal is being transitioned.

20 Claims, 18 Drawing Sheets

(56) References Cited

U.S. PATENT DOCUMENTS

| | | | | |
|---|---|---|---|---|
| 2011/0249033 | A1* | 10/2011 | Oh | G09G 3/3426 345/690 |
| 2012/0162289 | A1* | 6/2012 | Oniki | G09G 3/342 345/690 |
| 2014/0159614 | A1* | 6/2014 | Hussain | H05B 33/086 315/307 |
| 2014/0191936 | A1* | 7/2014 | Ho | G09G 3/3406 345/99 |
| 2016/0284282 | A1* | 9/2016 | Zhang | H05B 33/0827 |
| 2016/0351132 | A1* | 12/2016 | Joo | H05B 39/02 |

* cited by examiner

LIGHT EMITTING DIODE DRIVER CIRCUIT, DISPLAY APPARATUS INCLUDING THE SAME, AND METHOD FOR DRIVING LIGHT EMITTING DIODE

CROSS-REFERENCE TO RELATED APPLICATIONS

This application claims priority from Korean Patent Application No. 10-2015-0055458, filed on Apr. 20, 2015, in the Korean Intellectual Property Office, the disclosure of which is incorporated herein by reference in its entirety.

BACKGROUND

1. Field

Apparatuses and methods consistent with exemplary embodiments broadly relate to a light emitting diode driver circuit, a display apparatus including the same, and a method for driving a light emitting diode, and more particularly, to a light emitting diode driver circuit, a display apparatus including the same, and a method for driving a light emitting diode that may prevent flicker by varying a frequency of a clock signal according to a state value of a dimming signal.

2. Description of the Related Art

A liquid crystal display (LCD) that has a thin thickness, light weight, and low driving voltage and consumption power when compared to other displays is widely used. However, since the liquid crystal display is a non-emissive element that does not autonomously emit light, it has a need for a separate backlight for supplying light to a liquid crystal display panel.

As a backlight light source of the liquid crystal display, a cold cathode fluorescent lamp (CCFL), a light emitting diode (LED), and the like are often used. The cold cathode fluorescent lamp (CCFL) had disadvantages that since it uses mercury, it may cause environmental pollution, has a slow response speed, has a low color reproducibility, and is not suitable for thinness and lightness of the LCD panel.

On the other hand, the light emitting diode has advantages that since it does not use an environmental harmful substance, it is environmentally friendly, and an impulse driving is possible. Further, the light emitting diode has advantages in that it has excellent color reproducibility, it may arbitrarily change luminance, color temperature, and the like, by controlling an amount of light of red, green, and blue light emitting diodes. It is also suitable for thinness and lightness of the LCD panel. Accordingly, recently, the light emitting diode is often employed as the backlight light source of the LCD panel, and the like.

As such, in an LCD backlight employing the light emitting diode, a current supplied to the light emitting diode is varied in response to brightness information of an image for improving image quality and reducing power consumption.

Such current supplied to the light emitting diode is performed in a unit of clock period in an integrated circuit (IC) that controls an LED driver circuit. If an operating timing between the clock period and a dimming signal corresponding to the brightness information is different, there is a case in which different constant currents are provided to the light emitting diode every period of the dimming signal. Particularly, there was a problem of flickering due to very large brightness difference when a dimming duty of the dimming signal is low; that is, a gray scale of a low brightness is represented.

SUMMARY

Exemplary embodiments may overcome the above disadvantages and other disadvantages not described above.

Also, exemplary embodiments are not required to overcome the disadvantages described above, and an exemplary embodiment may not overcome any of the problems described above.

An exemplary embodiment provides a light emitting diode driver circuit, a display apparatus including the same, and a method for driving a light emitting diode that may prevent flicker by varying frequency of a clock signal according to a state value of a dimming signal.

According to an aspect of an exemplary embodiment, a light emitting diode (LED) driver circuit includes an LED array; an LED driving circuit configured to provide a constant current to the LED array by a switching operation; and a driving controller configured to control the switching operation using a clock signal of a preset frequency so that the constant current corresponding to a dimming signal is provided to the LED array, where the driving controller varies frequency of the clock signal in response to a signal value indicating that the dimming signal is being transitioned.

The driving controller may use a first clock signal of a first preset frequency preset in response to the signal value indicating that the dimming signal has a first value, and may use a second clock signal of a second preset frequency higher than the first preset frequency in response to the signal value indicating that the dimming signal has a second value lower than the first value.

The driving controller may use a varied clock signal after a preset time, in response to the signal value indicating that the dimming signal is being transitioned.

The driving controller may use a first clock signal after a first preset time, in response to the signal value indicating that the dimming signal is being transitioned from a first value to a second value, lower than the first value, and may use a second clock signal after a second preset time that is longer than the first preset time in response to the signal value indicating that the dimming signal is being transitioned from the second value to the first value.

The first preset time may be longer than one period of the first clock signal, and the second preset time may be longer than one period of the second clock signal.

The driving controller may not vary the clock signal in response to the signal value indicating that the dimming signal is subsequently transitioned before the preset time lapses.

The driving controller may include a clock generator configured to generate a clock signal of a preset frequency; a switching element configured to perform the switching operation, a comparator configured to sense whether or not a current flowing in the switching element is greater than or equal to a preset current; an RS flip-flop configured to receive the clock signal as a set signal and to receive an output of the comparator as a reset signal; and an AND gate configured to perform an AND operation of an output of the RS flip-flop and the dimming signal and to provide the result of the AND operation to the switching element.

The clock generator may include a reference voltage outputter configured to output a reference voltage corresponding to a first preset frequency; a voltage controlled oscillator configured to generate the clock signal using the reference voltage; a gain configured to bypass the reference voltage to the voltage controlled oscillator in response to the signal value indicating that the dimming signal has a first value, and multiply a preset gain value with the reference voltage and provide the result to the voltage controlled oscillator in response to the signal value indicating that the dimming signal has a second value lower than the first value;

and a delayer configured to delay the dimming signal by a preset time and provide the delayed dimming signal to the gain.

The clock generator may include a reference voltage outputter configured to output a reference voltage corresponding to a first preset clock frequency; a voltage controlled oscillator configured to generate the clock signal using the reference voltage; a voltage selector configured to bypass the reference voltage to the voltage controlled oscillator in response to the signal value indicating that the dimming signal has a first value, and provide a second reference voltage corresponding to a second preset frequency to the voltage controlled oscillator in response to the signal value indicating that the dimming signal has a second value lower than the first value; and a delayer configured to delay the dimming signal by a preset time and to provide the delayed dimming signal to the voltage selector.

The clock generator may include a reference voltage outputter configured to output a reference voltage corresponding to a first preset frequency; a voltage controlled oscillator configured to generate the clock signal using the reference voltage; a clock selector configured to bypass and output the clock signal generated by the voltage controlled oscillator to the RS flip-flop in response to the signal value indicating that the dimming signal has a first value, and to provide an output of a second oscillator generating a second clock signal of a second preset frequency to the RS flip-flop in response to the signal value indicating that the dimming signal has a second value lower than the first value; and a delayer configured to delay the dimming signal by a preset time and provide the delayed dimming signal to the clock selector.

The clock generator may include a reference voltage outputter configured to output a reference voltage corresponding to a resistance value of a connected resistor; a voltage controlled oscillator configured to generate the clock signal using the reference voltage and to provide the generated clock signal to the RS flip-flop; a resistor selector configured to connect a first resistor having a first resistance value corresponding to a first preset clock frequency to the reference voltage outputter in response to the signal value indicating that the dimming signal has a first value, and to connect a second resistor having a second resistance value corresponding to a second preset frequency to the reference voltage outputter in response to the signal value indicating that the dimming signal has a second value lower than the first value; and a delayer configured to delay the dimming signal by a preset time and provide the delayed dimming signal to the resistor selector.

The delayer may include a first resistor configured to receive the dimming signal through one end thereof; a first diode configured to have an anode connected to the other end of the first resistor; a second resistor configured to be connected to one end of the first resistor and receive the dimming signal; a second diode configured to have a cathode connected to the other end of the second resistor; and a capacitor configured to be commonly connected to a cathode of the first diode and an anode of the second diode.

A first resistance value of the first resistor and a second resistance value of the second resistor may be different from each other.

The LED driving circuit may include a power source configured to provide power; a switching element configured to perform the switching operation; an inductor configured to have one end connected to the power source and the other end connected to one end of the switching element; a first resistor configured to have one end connected to the other end of the switching element and the other end connected to a ground terminal of the power source; a diode configured to have an anode commonly connected to the other end of the inductor and one end of the switching element, and the other end connected to one end of the LED array; a capacitor configured to have one end commonly connected to a cathode of the diode and said one end of the LED array, and the other end connected to the ground terminal of the power source; and a second resistor configured to have one end connected to the other end of the LED array and the other end connected to the ground terminal of the power source.

According to another aspect of an exemplary embodiment, a display apparatus includes a liquid crystal display (LCD) panel configured to receive an image signal and display an image; a backlight configured to include a light emitting diode (LED) array and provide a constant current corresponding to a dimming signal to the LED array to provide light having brightness corresponding to the dimming signal to the LCD panel; and an image signal provider configured to provide the image signal to the LCD panel, generate the dimming signal corresponding to the image signal, and provide the generated dimming signal to the backlight. The backlight controls the constant current provided to the LED array using a clock signal of a preset frequency, and varies a frequency of the clock signal in response to a signal value indicating that the dimming signal is being transitioned.

The backlight may include an LED array; an LED driving circuit configured to provide a constant current to the LED array by a switching operation of a switch element; and a driving controller configured to control the switch element using a clock signal of a preset frequency so that the constant current corresponding to a dimming signal is provided to the LED array, and vary the frequency of the clock signal in response to the signal value indicating that the dimming signal is being transitioned.

The driving controller may use a first clock signal of a first preset frequency in response to the signal value indicating that the dimming signal has a first value, and may use a second clock signal of a second preset frequency higher than the first preset frequency in response to the signal value indicating that the dimming signal has a second value lower than the first value.

According to yet another aspect of an exemplary embodiment, a method of driving a light emitting diode (LED) includes generating a pulse width modulated (PWM) control signal based on a value of current flowing in the LED array and a clock signal; generating a control signal for controlling a switching element based on the generated PWM control signal and a dimming signal; and varying a frequency of the clock signal in response to a signal value indicating that the dimming signal is being transitioned.

The varying the frequency of the clock signal may include, in response to the dimming signal being transitioned from a high value to a low value, varying the clock signal from a first clock signal of a first preset frequency to a second clock signal higher than the first preset frequency, and in response to the dimming signal being transitioned from the low value to the high value, the clock signal may be varied from the second clock signal to the first clock signal.

Generating the PWM control signal may include generating the PWM control signal using the varied clock signal after a preset time, in response to the dimming signal being transitioned.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Figure 1:
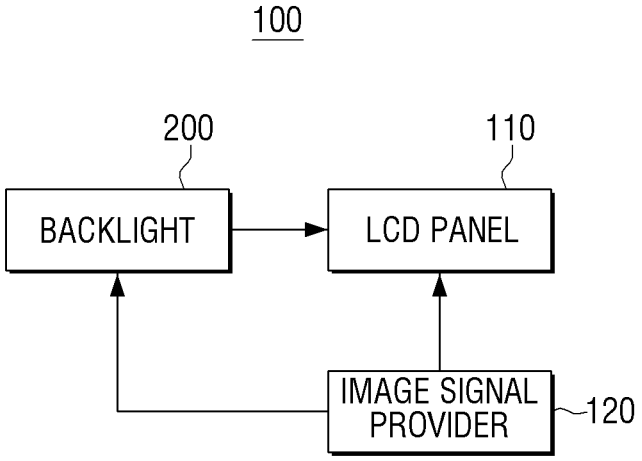
FIG. 1 is a block diagram illustrating a configuration of a display apparatus according to an exemplary embodiment.

The exemplary embodiments may be diversely modified. Accordingly, specific exemplary embodiments are illustrated in the drawings and are described in detail in the detailed description. However, it is to be understood that the present disclosure is not limited to a specific exemplary embodiment, but includes all modifications, equivalents, and substitutions without departing from the scope and spirit of the present disclosure. Also, well-known functions or constructions are not described in detail since they would obscure the disclosure with unnecessary detail.

The terms "first", "second", etc. may be used to describe diverse components, but the components are not limited by the terms. The terms are only used to distinguish one component from the others.

The terms used in the present application are only used to describe exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

In an exemplary embodiment, a "module" or a "unit" performs at least one function or operation, and may be implemented with hardware, software, or a combination of hardware and software. In addition, a plurality of "modules" or a plurality of "units" may be integrated into at least one module except for a "module" or a "unit" which has to be implemented with specific hardware, and may be implemented with at least one processor (not shown).

Hereinafter, exemplary embodiments will be described in more detail with reference to the accompanying drawings.

FIG. 1 is a block diagram illustrating a configuration of a display apparatus according to an exemplary embodiment.

Referring to FIG. 1, a display apparatus 100 according to an exemplary embodiment may include an LCD panel 110, an image signal provider 120, and a backlight 200.

The LCD panel 110 receives an image signal and displays an image. Specifically, the LCD panel 110, which is driven by a potential difference between a pixel electrode and a common electrode, may display a gray scale by transmitting light emitted from the backlight 200 through LC by the above-mentioned potential difference or controlling a transmittance degree. That is, the LCD panel 110 may display an image by controlling the LC in response to an image signal provided by an image signal provider 120 to be described below.

The image signal provider 120 provides the image signal to the LCD panel 110. Specifically, the image signal provider 120 may supply image data and/or various image signals for displaying the image data to the LCD panel 110 in response to the image data.

In addition, the image signal provider 120 may extract brightness information corresponding to the image signal, and may generate a dimming signal corresponding to the extracted brightness information. In addition, the image signal provider 120 may provide the generated dimming signal to a backlight 200. Such dimming signal may be a pulse width modulated (PWM) signal.

The backlight 200 emits light to the LCD panel 110. Specifically, the backlight 200 may include an LED array, and may provide light having brightness corresponding to the dimming signal to the LCD panel 110 by providing a constant current corresponding to the dimming signal to the LED array. Such backlight 200 may be referred to as an LED driver, an LED driver circuit, or the like.

In addition, the backlight 200 may control the constant current provided to the LED array using a clock signal of a preset frequency, and may vary the frequency of the clock signal when a signal value of the dimming signal is transitioned and may use the varied frequency of the clock signal. A detailed configuration and operation of the backlight 200, according to exemplary embodiments, will be described below with reference to FIGS. 3 to 17.

Figure 2:
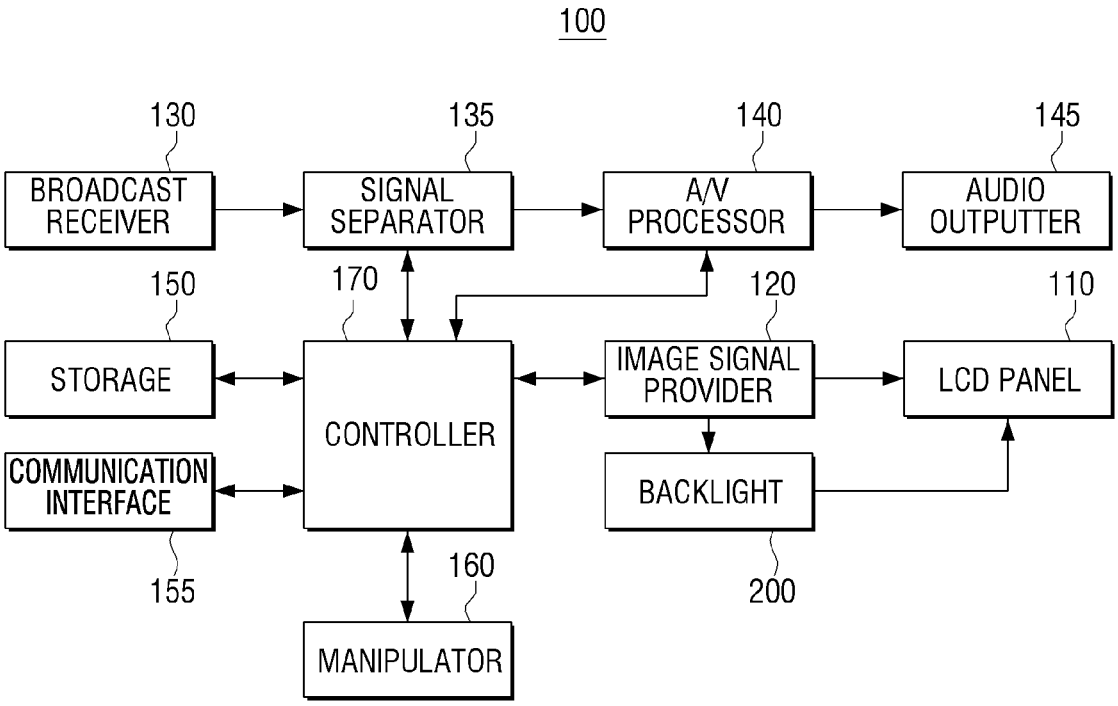
FIG. 2 is a block diagram illustrating a detailed configuration of a display apparatus according to an exemplary embodiment.

Hereinabove, although the configuration of the display apparatus 100 is described, according to an exemplary embodiment, the display apparatus 100 may include a configuration as illustrated in FIG. 2. A detailed configuration of the display apparatus 100 will be described below with reference to FIG. 2, according to an exemplary embodiment.

FIG. 2 is a block diagram illustrating a detailed configuration of a display apparatus according to an exemplary embodiment.

Referring to FIG. 2, the display apparatus 100 according to an exemplary embodiment includes the LCD panel 110, the image signal provider 120, a broadcast receiver 130, a signal separator 135, an A/V processor 140, an audio outputter 145, a storage 150, a communication interface 155, a manipulator 160, a controller 170, and the backlight 200.

Since the operations of the LCD panel 110 and the backlight 200 are analogous to the ones described above with reference to FIG. 1, repeated description will be omitted.

The broadcast receiver 130 receives broadcasts from a broadcasting station or a satellite, via a wired network or wirelessly and demodulates the received broadcast.

The signal separator 135 separates a received broadcasting signal into an image signal, an audio signal, and an additional information signal. In addition, the signal separator 135 transmits the separated image signal and audio signal to the A/V processor 140.

The A/V processor 140 performs signal processing such as video decoding, video scaling, audio decoding, and the like for the image signal and the audio signal transmitted from the broadcast receiver 130 and the storage 150. In addition, the A/V processor 140 outputs the image signal to the image signal provider 120, and outputs the audio signal to the audio outputter 145.

On the other hand, in the case in which the received image and audio signals are stored in the storage 150, the A/V processor 140 may output the image and the audio in compressed form to the storage 150.

The audio outputter 145 converts the audio signal output from the A/V processor 140 into sound to output the sound through a speaker (not illustrated) or to output the sound to an external device connected through an external output terminal (not illustrated).

The image signal provider 120 generates a graphic user interface (GUI) to be provided to a user. In addition, the image signal provider 120 may add the GUI to the image output from the A/V processor 140. In addition, the image signal provider 120 provides to the LCD panel 110 an image signal corresponding to the image to which the GUI is added. Accordingly, the LCD panel 110 displays a variety of information provided by the display apparatus 100 and the image transmitted from the image signal provider 120.

In addition, the image signal provider 120 may generate brightness information corresponding to the image signal provided to the LCD panel 110, and may generate a dimming signal corresponding to the generated brightness information. Such dimming signal may be a pulse width modulated (PWM) signal that has a preset frequency and a duty ratio, which varies according to a brightness value.

In addition, the image signal provider 120 may provide the generated dimming signal to the backlight 200. Meanwhile, hereinabove, although it is described that the image signal provider 120 generates the dimming signal for the backlight 200, according to exemplary embodiments, the LCD panel 110 may generate the dimming signal and provide the dimming signal to the backlight 200.

In addition, the storage 150 may store image contents. Specifically, the storage 150 may receive and store image contents in which the image and the audio are compressed from the A/V processor 140, and may output the stored image contents according to a control by the controller 170 to the A/V processor 140. Meanwhile, the storage 150 may be implemented as a hard disk, a non-volatile memory, a volatile memory, and the like.

The manipulator 160 is implemented as a touch screen, a touch pad, a key button, a key pad, and the like, to provide a manipulation of a user to the display apparatus 100. Although an exemplary embodiment describes that a control command is received through the manipulator 160 included in the display apparatus 100, the manipulator 160 may also receive the manipulation of the user from an external control device (e.g., remote controller). That is, the control command may also be received through the communication interface 155 to be described below.

The communication interface 155 is formed to connect the display apparatus 100 to an external device (not illustrated), and may be connected to the external device via a local area network (LAN) and an Internet network and may also be connected to the external device via a universal serial bus (USB) port. If the image contents may be transmitted and received through the above-mentioned communication interface 155, the control command for controlling the display apparatus 100 may also be received.

The controller 170 may control general operations of the display apparatus 100. Specifically, the controller 170 may control the LCD panel 110, the image signal provider 120, and the backlight 200 so that an image according to the control command received through the manipulator 160 is displayed.

As described above, the display apparatus according to an exemplary embodiment varies the frequency of the clock signal in the backlight according to a transition of the signal value of the dimming signal, thereby making it possible to minimize a time difference between a timing at which the dimming signal is applied and a timing at which the LED driver circuit is operated. Accordingly, the same constant current may be provided to the light emitting diode every period of the dimming signal. Particularly, in the case in which a dimming duty of the dimming signal is low, that is, even when a gray scale of low brightness is represented, the brightness difference may be maintained to be equal.

Meanwhile, in describing FIG. 2, although it is described that the functions as described above are applied to only the display apparatus that receives and represents the broadcast, the light emitting diode driver circuit to be described below may also be applied to any electronic device having the LCD panel.

Meanwhile, hereinabove, although it is described that the backlight 200 is included in the display apparatus 100, a function of the backlight 200 may also be implemented as a separate apparatus. Hereinafter, a separate light emitting diode driver circuit that performs the same function as that of the backlight 200 will be described with reference to FIG. 3, according to an exemplary embodiment.

Figure 3:
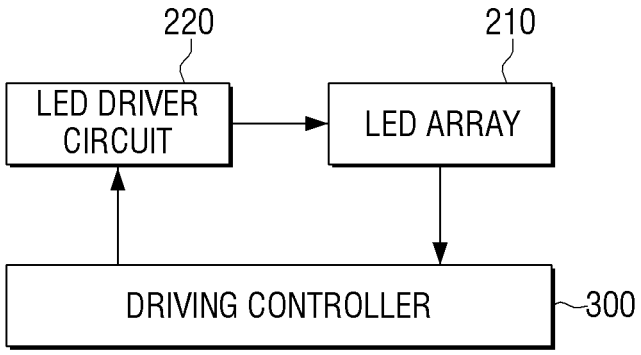
FIG. 3 is a block diagram illustrating a configuration of a light emitting diode driver circuit according to an exemplary embodiment.

FIG. 3 is a block diagram illustrating a configuration of a light emitting diode driver circuit according to an exemplary embodiment.

Referring to FIG. 3, a light emitting diode driver circuit such as a backlight 200 depicted in FIG. 2 (or a light emitting diode driver) may include an LED array 210, an LED driving circuit 220, and a driving controller 300. The light emitting diode driver circuit may be mounted in the display apparatus 100, the light emitting diode driver circuit may perform similar operations as that of the backlight 200 of FIG. 1. In addition, in an exemplary embodiment or a variation thereof, the light emitting diode driver circuit may also include the configuration of the LED driving circuit 220 and the driving controller 300 without the LED array 210, which may be positioned separately, outside of the light emitting diode driver circuit.

The LED array 210 emits light. Specifically, the LED array 210 in which a plurality of light emitting diodes (LEDs) are connected in series with each other, emits light. The brightness of the emitted light corresponds to an amplitude of a current provided from the LED driving circuit 220. Although an exemplary embodiment illustrates a single LED array in the light emitting diode driver circuit, exemplary embodiment is not limited thereto and is provided by way of an example only. A plurality of LED arrays may be provided in the light emitting diode driver circuit. According to an exemplary embodiment, the plurality of LED arrays may be disposed in various forms such as in series, in parallel, or in series/parallel.

The LED driving circuit 220 provides a constant current to the LED array 210 by a switching operation of a switch element. Specifically, the LED driving circuit 220 may provide the constant current to the LED array 210 in a step-up circuit type. A configuration and operation of the LED driving circuit 220 will be described below with reference to FIGS. 4 to 6, according to an exemplary embodiment.

The driving controller 300 controls the switch element using a clock signal of a preset frequency so that a current corresponding to the dimming signal is provided to the LED array 210. Specifically, the driving controller 300 may control a fast switching of the switch element of the LED driving circuit 220 so that a constant current corresponding to the dimming signal flows in the LED array 210, by comparing a current flowing in the LED array 210 with a preset current.

In addition, when a signal value of the dimming signal is transitioned, the driving controller 300 varies the frequency of the clock signal. Specifically, when the dimming signal has a high value, the driving controller 300 may generate a control signal for controlling the switch element using a first clock signal of a preset first frequency. In addition, when the dimming signal has a low value, the driving controller 300 may sense whether or not the dimming signal is changed to the high value, using a second clock signal of a second frequency higher than the first frequency. For example, in the case in which the first clock signal is 10 KHz, when the dimming signal has the low value, the driving controller 300 may sense the transition of the dimming signal using a clock signal of 1 to 10 MHz.

In addition, when a preset time lapses after the transition of the dimming signal, the driving controller 300 may perform the frequency variation described above, according to an exemplary embodiment. Specifically, in the case in which the dimming signal is transitioned from the high value to the low value, the driving controller 300 may use the second clock signal and may then use the first clock signal after a first preset time. In addition, in the case in which the dimming signal is transitioned from the low value to the high value, the driving controller 300 may use the first clock signal and may then use the second clock signal after a second preset time. Meanwhile, in the case in which the dimming signal is transitioned from the high value to the low value and is then again transitioned to the high value before the first preset time lapses, the clock signal is not transitioned. According to an exemplary embodiment, the first preset time may be longer than one period of the first clock signal, and the second preset time may be longer than one period of the second clock signal. The reason that the frequency variation is performed while having a delay will be described below with reference to FIG. 12, according to an exemplary embodiment.

The above-mentioned driving controller 300, according to an exemplary embodiment, may be implemented in a digital circuit and an analog circuit. In the case in which the driving controller 300 is implemented in the digital circuit, the operation as described above may be reflected in an algorithm form, and in the case in which the driving controller 300 is implemented in the analog circuit, the driving controller 300 may be implemented as illustrated in FIGS. 13, 15, 16, and 17.

Figure 4:
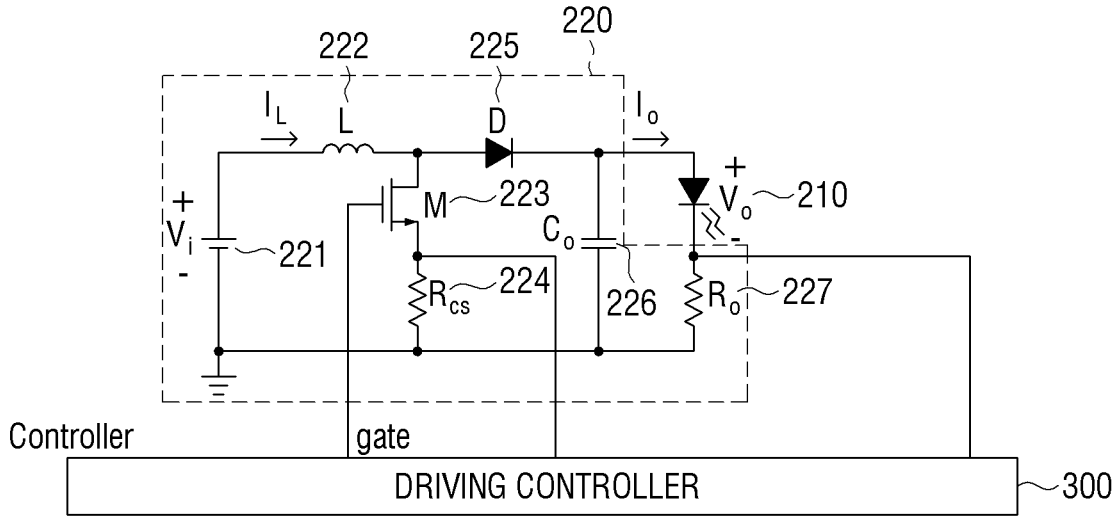
FIG. 4 is a circuit diagram illustrating an LED driving circuit according to an exemplary embodiment.

FIG. 4 is a diagram illustrating an LED driving circuit according to an exemplary embodiment.

Referring to FIG. 4, the LED driving circuit 220 includes a power source 221, an inductor 222, a switch element 223, a first resistor 224, a first diode 225, a first capacitor 226, and a second resistor 227, in a step-up circuit type, according to an exemplary embodiment. The power source 221, the inductor 222, the switch element 223, the first resistor 224, and the first diode 225 may be referred to as a DC-DC power converter or may be referred to as a booster switch.

The power source 221 supplies power to the LED driving circuit 220.

The inductor 222 has one end connected to one end of the power source 221, and the other end commonly connected to one end of the switch element 223 and an anode of the first diode 225.

The switch element 223 performs a switching operation based on a control signal from the driving controller 300. The switch element 223 may have one end commonly connected to the other end of the inductor 222 and the anode of the diode 225, and the other end connected to one end of the first resistor 224. The above-mentioned switching element 223 may be implemented as a metal-oxide semiconductor field-effect-transistor (MOSFET) for a fast switching.

The first resistor 224 has one end connected to the other end of the switch element 223, and the other end connected to a ground terminal of the power source 221. Here, the first resistor 224 is a sensing resistor configured to sense a current flowing in the inductor 222, when the switch element 223 is in an ON state.

The first diode 225 has an anode which is commonly connected to the other end of the inductor 222 and one end of the switching element 223, and a cathode which is commonly connected to one end of the first capacitor 226 and one end of the LED array 210 (specifically, an anode in the LED array 210).

The first capacitor 226 has one end which is commonly connected to the cathode of the first diode 225 and one end of the LED array 210 (specifically, the anode in the LED array 210), and the other end connected to the ground terminal of the power source 221.

The second resistor 227 has one end connected to the other end of the LED array 210 (specifically, the cathode in the LED array 210), and the other end connected to the ground terminal of the power source 221. Here, the second resistor 227 is a sensing resistor configured to sense a current flowing in the LED array 210.

A current control operation of the LED driving circuit 220 depending on a switching state of the switch element 223, according to an exemplary embodiment, will be described with reference to FIGS. 5 and 6.

Figure 5:
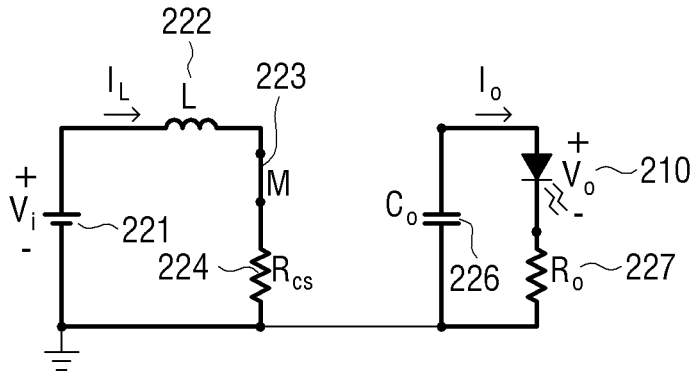
FIGS. 5 and 6 are diagrams illustrating an operation of the light emitting diode driver circuit based on a switching state according to an exemplary embodiment.

FIG. 5 is a diagram illustrating an LED driving circuit when the switching element is in an ON state, according to an exemplary embodiment.

Referring to FIG. 5, if the switching element (such as the switching element 223 shown in FIG. 4) is turned on, a current in a first current path is increased while the inductor 222 is charged. According to an exemplary embodiment, the first diode 225 is shorted (accordingly, not shown in FIG. 5), and the LED array 210 is supplied with power from the charges in the first capacitor 226. That is, as illustrated in FIG. 5, the LED driver circuit has a current path classified into a first current path passing through the power source 221, the inductor 222, the switch element 223, and the first resistor 224, and a second current path passing through the first capacitor 226, the LED array 210, and the second resistor 227.

Figure 6:
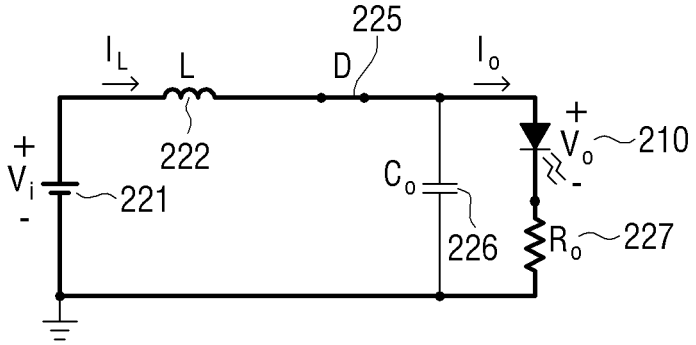

FIG. 6 is a diagram illustrating an LED driving circuit when the switching element is in an OFF state according to an exemplary embodiment.

Referring to FIG. 6, if the switch element (such as the switch element 223 shown in FIG. 4) is turned off, the LED driving circuit 220 has a third current path passing through the power source 221, the inductor 222, the first diode 225, the LED array 210, and the second resistor 227. Accordingly, a current charged in the inductor 222 is discharged to a load side.

In an exemplary embodiment, if an output current is less than a target value, the current charged in the inductor 222 is increased while a duty of the switch element 223 (not shown in FIG. 6) is increased, and consequently, the output current is also gradually increased.

Conversely, if the output current is higher than the target value, the current charged in the inductor 222 is decreased while the duty of the switch element 223 is decreased, and consequently, the output current is also gradually decreased.

For the operations, as described above, the driving controller 300 may detect an output current of the LED array 210 using a voltage value of the second resistor 227. An operation of the driving controller 300, according to an exemplary embodiment, will be described in greater detail below with reference to FIG. 7.

In describing exemplary embodiments depicted in FIGS. 4 to 6, although it is illustrated and described that the LED driving circuit is the step-up circuit, the LED driver circuit may also be implemented as a step-down circuit and exemplary embodiments are not limiting.

Figure 7:
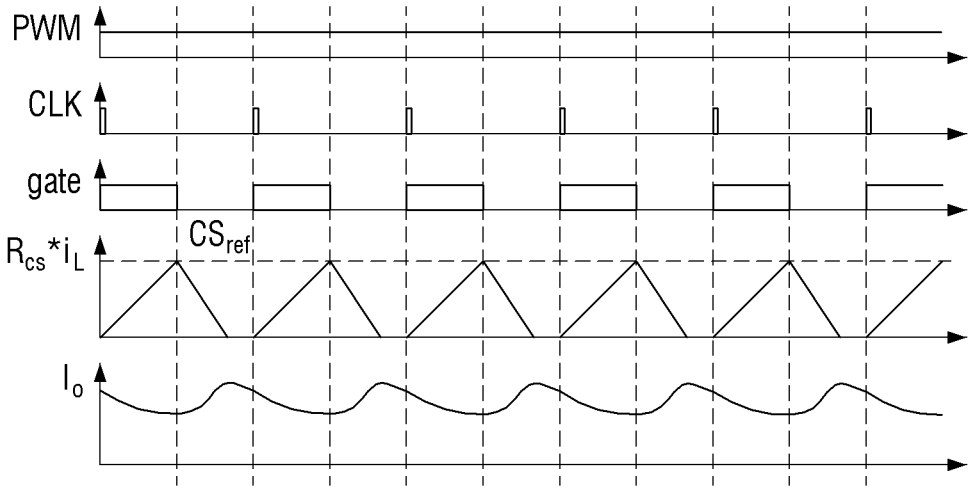
FIGS. 7 to 11 are waveform diagrams illustrating main signals according to various application timings of a dimming signal according to exemplary embodiments.

FIG. 7 is a waveform diagram of main signals where the dimming signal maintains the high value according to an exemplary embodiment.

Referring to FIG. 7, the driving controller 300 may detect a target peak value by calculating a difference between the current flowing in the LED array 210 and a preset current value, using the second resistor 227, which is the sensing resistor.

According to an exemplary embodiment, the detected target peak value CSref is a maximum target value of an inductor current IL. Specifically, when an output current Io sensed by the second resistor 227 is lower than a reference current Iref (not shown), the target peak value CSref is further increased, and conversely, when the output current Io sensed by the second resistor 227 is higher than the reference current Iref (not shown), the target peak value CSref is further decreased. Rcs is a resistance for detecting the IL when the switching element 223 is ON.

In addition, the driving controller 300 compares the target peak value CSref and the inductor current IL detected through the first resistor 224 with each other for an ON section of the switching element 223, and controls the switch element 223 to be turned off when the inductor current IL is larger than the target peak value CSref, thereby making it possible to limit a peak value of a current flowing in the inductor 222 to the target peak value CSref. Accordingly, if the target peak value CSref is increased, the peak value of the inductor current is also increased, and conversely, if the target peak value CSref is decreased, the peak value of the inductor current is also decreased.

Therefore, as illustrated in FIG. 7, according to an exemplary embodiment, when the value of the inductor current IL is equal to the target peak value CSref, a gate signal controlling the switch element 223 is turned off, and the gate signal controlling the switching element 223 is again turned on at a timing at which the clock signal is turned on.

In order to describe a relationship between the dimming signal and the clock signal, various exemplary embodiments are described below. An exemplary embodiment of an operation in which the dimming signal and the clock signal are synchronized will be described with reference to FIG. 8.

Figure 8:
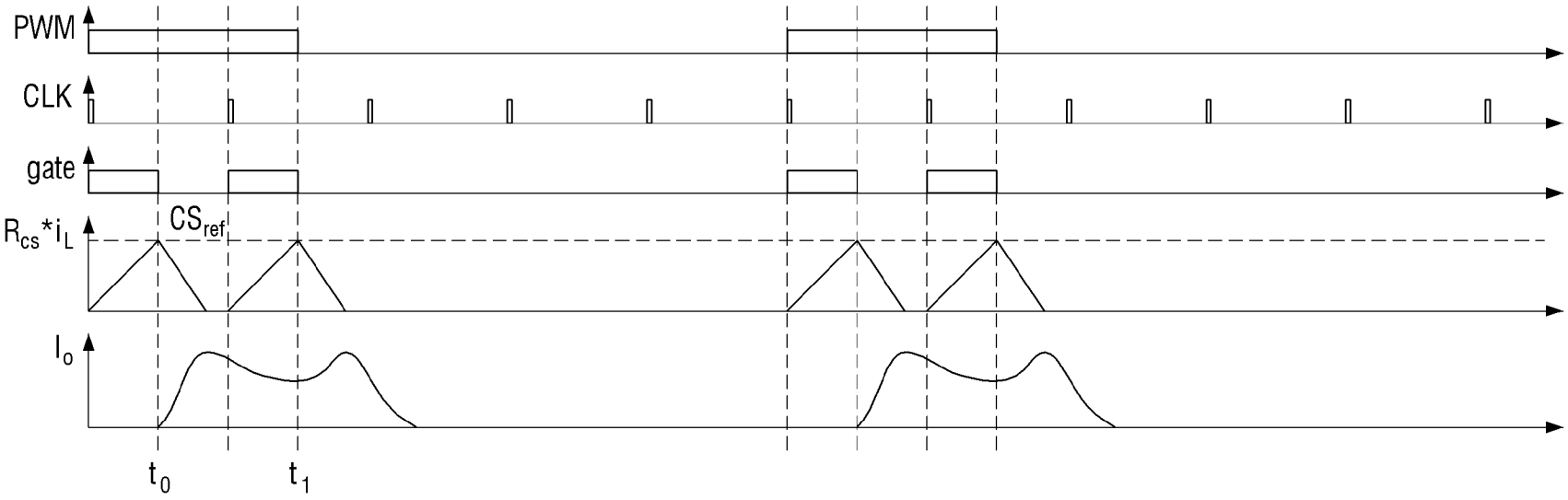

Referring to FIG. 8, the dimming signal and the clock signal are synchronized with each other and the gate signal and a shape of the current provided to the LED array 210 at the timing of t=0 and t=t1 are the same.

However, since the dimming signal is provided from the image signal provider 120 outside the backlight 200 as described above, it is realistically impossible for the image signal provider 120 to provide the dimming signal synchronized with the clock signal in a control integrated circuit (IC) in the backlight 200. Accordingly, the dimming signal may be input after the clock signal or may be input prior to the clock signal. Hereinafter, an operation in which the dimming signal and the clock signal are not synchronized will be described, according to an exemplary embodiment.

Figure 9:
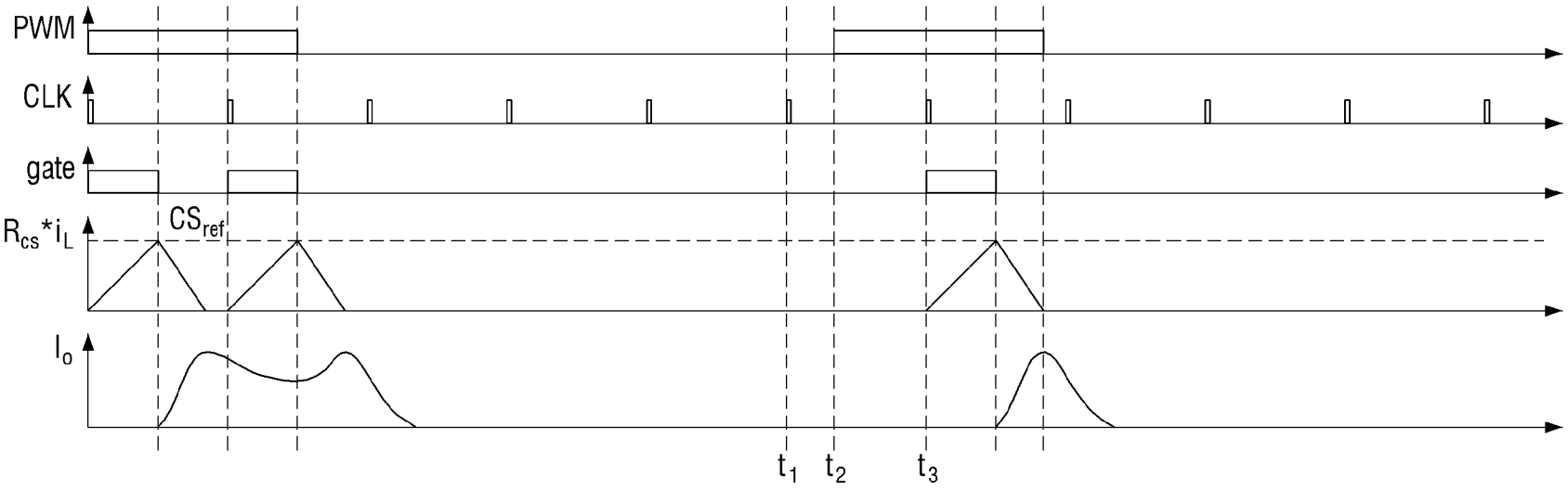
Figure 10:
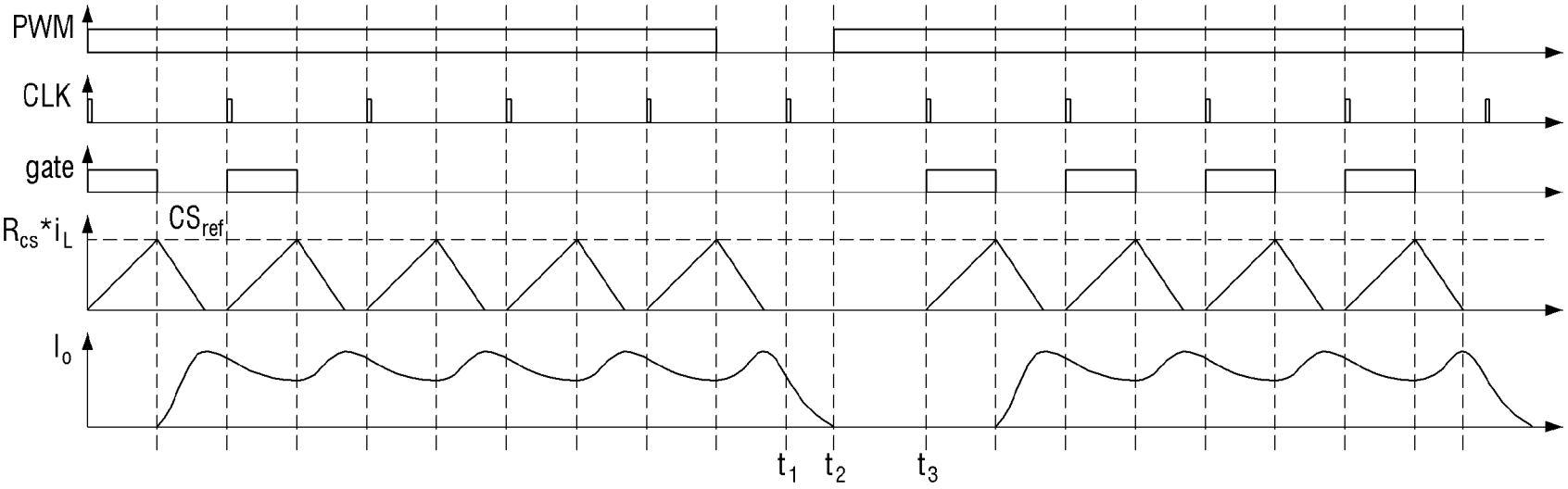

FIGS. 9 and 10 are waveform diagrams illustrating main signals in which the dimming signal is applied later than the clock signal according to exemplary embodiments.

Referring to FIG. 9, according to an exemplary embodiment, the first dimming signal PWM is initially synchronized with the clock signal, but in a next period, the first dimming signal PWM is input at a time t2 which is delayed as compared to the clock signal (t1). Accordingly, it may be appreciated that in the second dimming signal PWM, a time at which the switch element is turned on is reduced from two times to once as compared to the previous case of the first dimming signal PWM, and as a result, a shape of the output current of the LED array also has a narrower width than at a time of a first dimming PWM.

Referring to FIG. 10, according to an exemplary embodiment, the dimming signal PWM is initially synchronized with the clock signal at the time of the first dimming, but in the second dimming signal of a next period, the dimming signal PWM (input at time (t2)) is input faster than the clock signal (t3) (or the dimming signal PWM is input later than the clock signal (t1)). Accordingly, it may be appreciated that in a second dimming section, the number of times and a time at which the switch element is turned on are reduced as compared to a first dimming section, and as a result, a time of the output current of the LED array also has a narrower width than the first dimming section.

Figure 11:
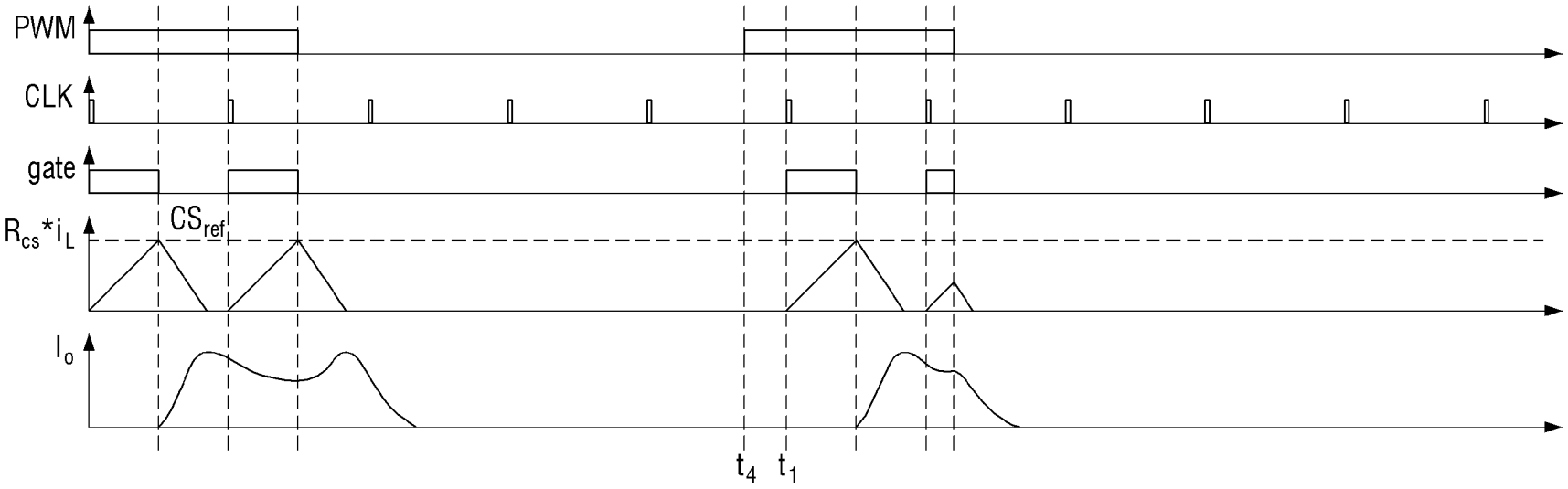

FIG. 11 is a waveform diagram of main signals in which the dimming signal is applied faster than the clock signal according to an exemplary embodiment.

Referring to FIG. 11, the dimming signal is synchronized with the clock signal at the time of the first dimming, but in a dimming signal of a next period, the dimming signal PWM is input faster (t4) than the clock signal (t1). It may be appreciated that the number of times at which the switch element is turned on is the same, but a time at which the switch element is turned on again is reduced unlike the previous case, and as a result, the time of the output current of the LED array also has a narrower width than the first dimming.

As such, in an exemplary embodiment, it may be appreciated that if the clock signal and the dimming signal are not synchronized with each other, a screen having different brightness may be displayed depending on the period of the dimming signal. Particularly, when a dimming duty is low as illustrated in FIG. 9, by way of an example, there is a problem that flicker occurs due to a very large brightness difference.

In order to solve the above-mentioned problem, according to an exemplary embodiment, even though the dimming signal is applied at any timing, a delay between the timing and a next clock may be minimized by increasing the clock frequency in the driving controller 300 in an OFF section of the dimming signal. A description thereof will be provided below with reference to FIG. 12, according to an exemplary embodiment.

Figure 12:
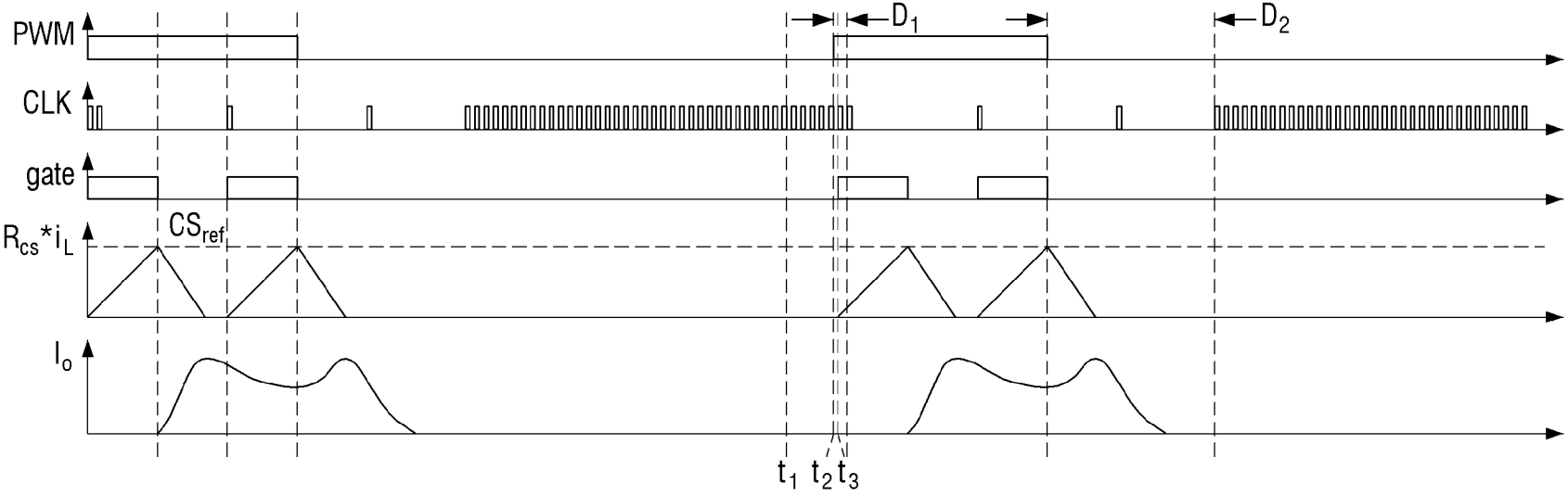
FIG. 12 is a waveform diagram illustrating main signals based on a driving scheme according to an exemplary embodiment.

FIG. 12 is a waveform diagram of main signals in which the clock signal is varied, according to an exemplary embodiment.

Referring to FIG. 12, the clock frequency becomes very high, a time interval between a timing t2 at which a PWM dimming is applied and a timing t3 at which the gate signal is output becomes very short, and current waveforms in the first dimming section and the second dimming section become equal to each other.

In addition, in order to perform a normal current control, the clock frequency in the driving controller 300 may again be decreased in an ON section of the driving controller 300 for the same operation as the previous case.

However, such change in the clock frequency is preferably performed at a timing delayed from a transition timing of the dimming signal. Specifically, as described above, according to an exemplary embodiment, the gate control signal is turned on in a state in which both the dimming signal and the clock signal are turned on. According to an exemplary embodiment, if the clock signal and the dimming signal are not synchronized with each other, the gate control signal is turned on in the clock signal after the dimming signal is transitioned to the high value.

Therefore, if the frequency of the clock signal is decreased immediately at a timing at which the dimming signal is transitioned to the high value, the gate control signal is turned on after a period of the decreased frequency. As a result, an effect explained above does not appear. Therefore, if the dimming signal is transitioned from the low value to the high value, the driving controller 300 may change the clock signal after delaying the dimming signal by the second time. Here, according to an exemplary embodiment, the second time is longer than one period or more of the second clock signal, but is preferably short, if possible.

According to an exemplary embodiment, even in a section in which the dimming signal is transitioned from the high value to the low value, the delay described above may preferably be applied. Specifically, if the duty of the dimming signal is very high, that is, if the dimming signal is transitioned from the low value to the high value as soon as the change to the second clock signal of high frequency is performed at a timing at which the dimming signal is transitioned to the low value, the driving controller controls the switch element 223 by the clock signal of high frequency. As a result, distortion may occur in the LED current waveform.

Therefore, the driving controller 300 may perform the transition from the first clock signal to the second clock signal after delaying the dimming signal by the first time. Meanwhile, if the transition of the dimming signal is performed before the first time is delayed, the change of the clock signal is not performed.

Hereinafter, a configuration of the driving controller 300 for operations such as the ones described above will be described below with reference to FIGS. 13, 15, 16, and 17, according to an exemplary embodiment. These examples are of an analog driving controller, if the driving controller is implemented as a digital IC, the operations such as the ones described above may be reflected by an algorithm (or control code).

Figure 13:
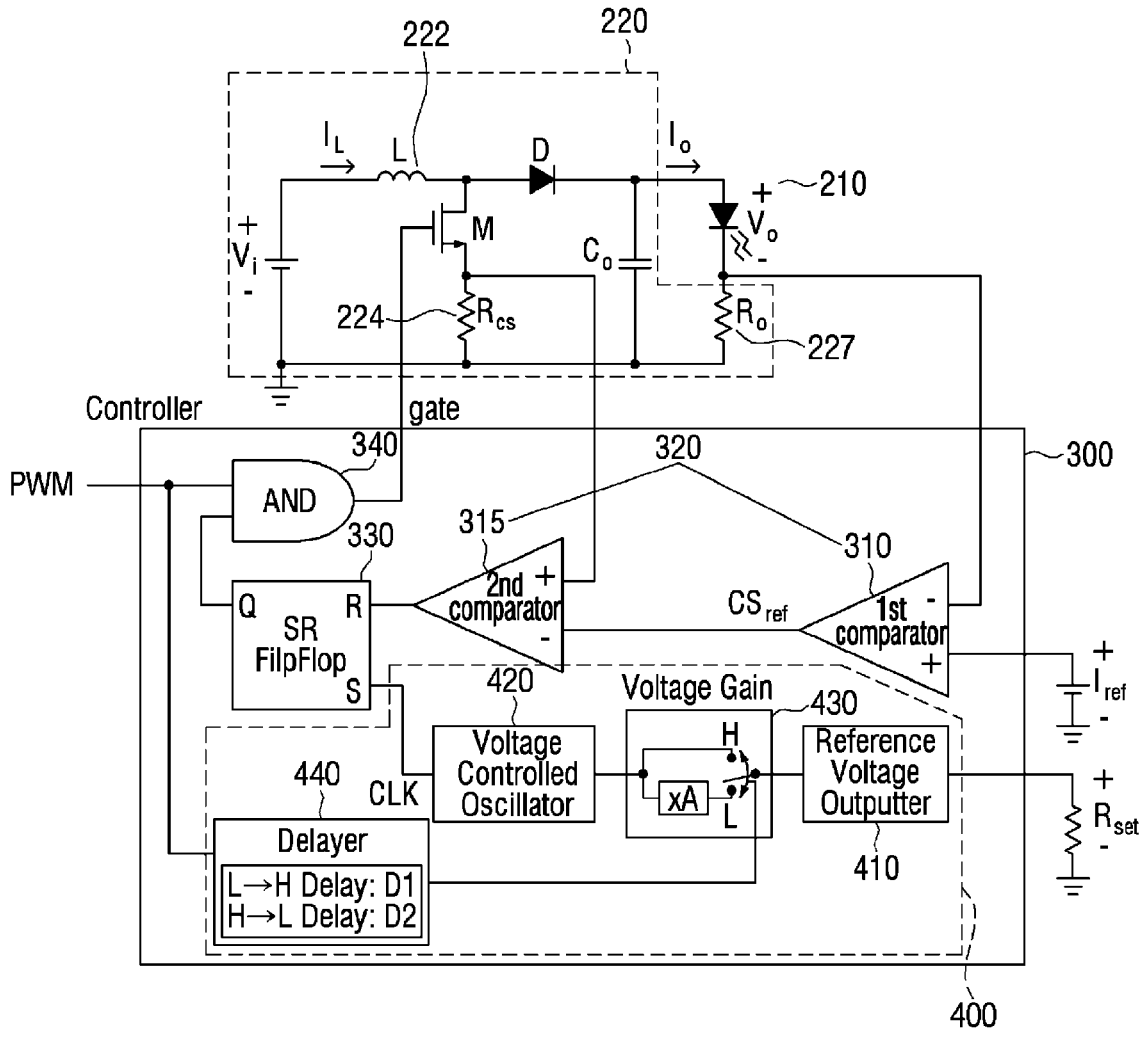
FIG. 13 is a diagram illustrating a driving controller according to an exemplary embodiment.

FIG. 13 is a block diagram illustrating a configuration of a driving controller according to an exemplary embodiment.

Referring to FIG. 13, the driving controller 300 includes a comparator 320, an RS flip-flop 330 (or an SR flip-flop), an AND gate 340, and a clock generator 400.

The comparator 320 may sense whether or not the current flowing in the switch element is a preset current or is greater than the preset current. Specifically, the comparator 320 may include a first comparator 310 and a second comparator 315, in order to sense whether or not a current flowing in the inductor is a target peak value.

The first comparator 310 compares a difference between the current flowing in the LED array 210 and the preset current Iref. Specifically, the first comparator 310 may be implemented as an operational amplifier (OP-AMP), may receive a voltage of the second resistor 227 which is connected in series with the LED array 210 through a negative terminal of the OP-AMP, may receive a voltage value corresponding to amplitude of the preset current through a positive terminal thereof, and may provide a difference CSref between the voltage of the second resistor 227 and the voltage value corresponding to amplitude of the preset current to the second comparator 315. According to an exemplary embodiment, CSref may be referred to as the target peak value of the inductor current.

The second comparator 315 compares a difference between the current flowing in the inductor 222 and the target current peak value CSref. That is, the second comparator 315 may determine whether or not the current flowing in the inductor 222 is larger than the target current peak value. Specifically, the second comparator 315 may be implemented as an operational amplifier (OP-AMP), may receive an output of the first comparator 310 through the negative terminal of the OP-AMP, may receive a voltage value of the first resistor 224, which is a voltage corresponding to an amplitude of the current flowing in the inductor through the positive terminal thereof, and may provide a difference between the output of the first comparator 310 and the voltage value of the first resistor 224 to the RS flip-flop 330.

The RS flip-flop 330 may receive the clock signal through a set input, may receive an output of the comparator 320 through a reset input, and may generate a PWM control signal corresponding to two input values. According to an exemplary embodiment, the RS flip-flop is a flip-flop that outputs '1' when a set signal is received and outputs '0' when a reset signal is received. Meanwhile, although an exemplary embodiment illustrates the PWM control signal being generated using the RS flip-flop 330, this is provided by way of an example only and not by way of a limitation. The PWM control signal may also be generated using another flip-flop or another circuit configuration.

The AND gate 340 performs an AND operation for the output of the RS flip-flop and the dimming signal and provides the result to the switch element.

The clock generator 400 generates a clock signal of a preset frequency. Specifically, the clock generator 400 may generate the clock signal as described with reference to FIG. 12, according to an exemplary embodiment. That is, the clock generator 400 may generate a first clock signal of a first frequency in a state in which the dimming signal is turned on, and may generate a second clock signal of a second frequency higher than the first frequency after a delay of a first preset time when the dimming signal is transitioned from an ON state to an OFF state. In addition, the dimming signal is again transitioned from the OFF state to the ON state, the clock generator 400 may generate the first clock signal of the first frequency after a delay of a second preset time.

The clock generator 400 according to an exemplary embodiment may include a reference voltage outputter 410, a voltage controlled oscillator 420, a delayer 440, and a gain 430.

The reference voltage outputter 410 outputs a reference voltage corresponding to the first preset frequency. Specifically, the reference voltage outputter 410 may generate the reference voltage corresponding to a resistance value (specifically, a reference resistor) obtained from the outside. That is, the reference voltage outputter 410 may be connected to a resistor Rset, which is disposed outside the clock generator 400 and the controller 300.

The voltage controlled oscillator 420 generates the clock signal using the reference voltage. Specifically, if the voltage controlled oscillator 420 receives the reference voltage from the reference voltage outputter 410, the voltage controlled oscillator 420 may generate the first clock signal corresponding to the reference voltage. Conversely, if the voltage controlled oscillator 420 receives a reference voltage to which a gain value (here, the gain value is a positive integer more than 1, by way of an example) is applied, from the gain 430 to be described below, the voltage controlled oscillator 420 may generate the second clock signal.

The delayer 440 delays the dimming signal by a preset time and provides the delayed dimming signal to the gain 430. An exemplary embodiment of the delayer 440 will be described below with reference to FIG. 14. Although FIG. 14 illustrates an analog circuit for the delayer 440, this is provided by way of an example only and not by way of a limitation, it is apparent that the delayer 440 may be implemented using a digital circuit or another circuit (buffer) configuration.

The voltage gain 430 bypasses the reference voltage to the voltage controlled oscillator 420 when the dimming signal has a high value, and multiplies a preset gain value with the reference voltage and provides the result to the voltage controlled oscillator 420 when the dimming signal has a low value.

As described above, according to an exemplary embodiment, the clock generator 400 varies the clock frequency according to the transition of the dimming signal, thereby making it possible to minimize time difference between a timing at which the dimming signal is applied and a timing at which the LED driver circuit is operated. In addition, the driving controller 300 is operated using the above-mentioned clock generator 400, thereby making it possible to provide the same constant current to the light emitting diode every period of the dimming signal.

Figure 14:
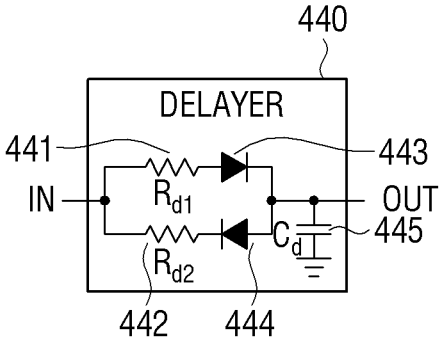
FIG. 14 is a circuit diagram illustrating a delayer according to an exemplary embodiment.

FIG. 14 is a diagram illustrating a delayer according to an exemplary embodiment.

Referring to FIG. 14, the delayer 440 includes a third resistor 441, a fourth resistor 442, a second diode 443, a third diode 444, and a second capacitor 445.

The third resistor 441 has a resistance value that determines the second delay time, when the dimming signal is transitioned from the low value to the high value. Specifically, one end of the third resistor 441 receives the dimming signal, and the other end thereof is connected to an anode of the second diode 443.

The fourth resistor 442 has a resistance value that determines the first delay time, when the dimming signal is transitioned from the high value to the low value. Specifically, one end of the fourth resistor 442 receives the dimming signal, and the other end thereof is connected to a cathode of the third diode 444. Meanwhile, at the time of implementing, resistance values of the third resistor and the fourth resistor may be the same as each other, but may also be different from each other.

The anode of the second diode 443 is connected to the other end of the third resistor 441, and the cathode thereof is commonly connected to an anode of the third diode 444 and one end of the second capacitor 445.

The cathode of the third diode 444 is connected to the other end of the fourth resistor 442, and the anode thereof is commonly connected to a cathode of the second diode 443 and one end of the second capacitor 445.

The second capacitor 445 has one end which is commonly connected to the cathode of the second diode 443 and the anode of the third diode 444, and the other end grounded.

Figure 15:
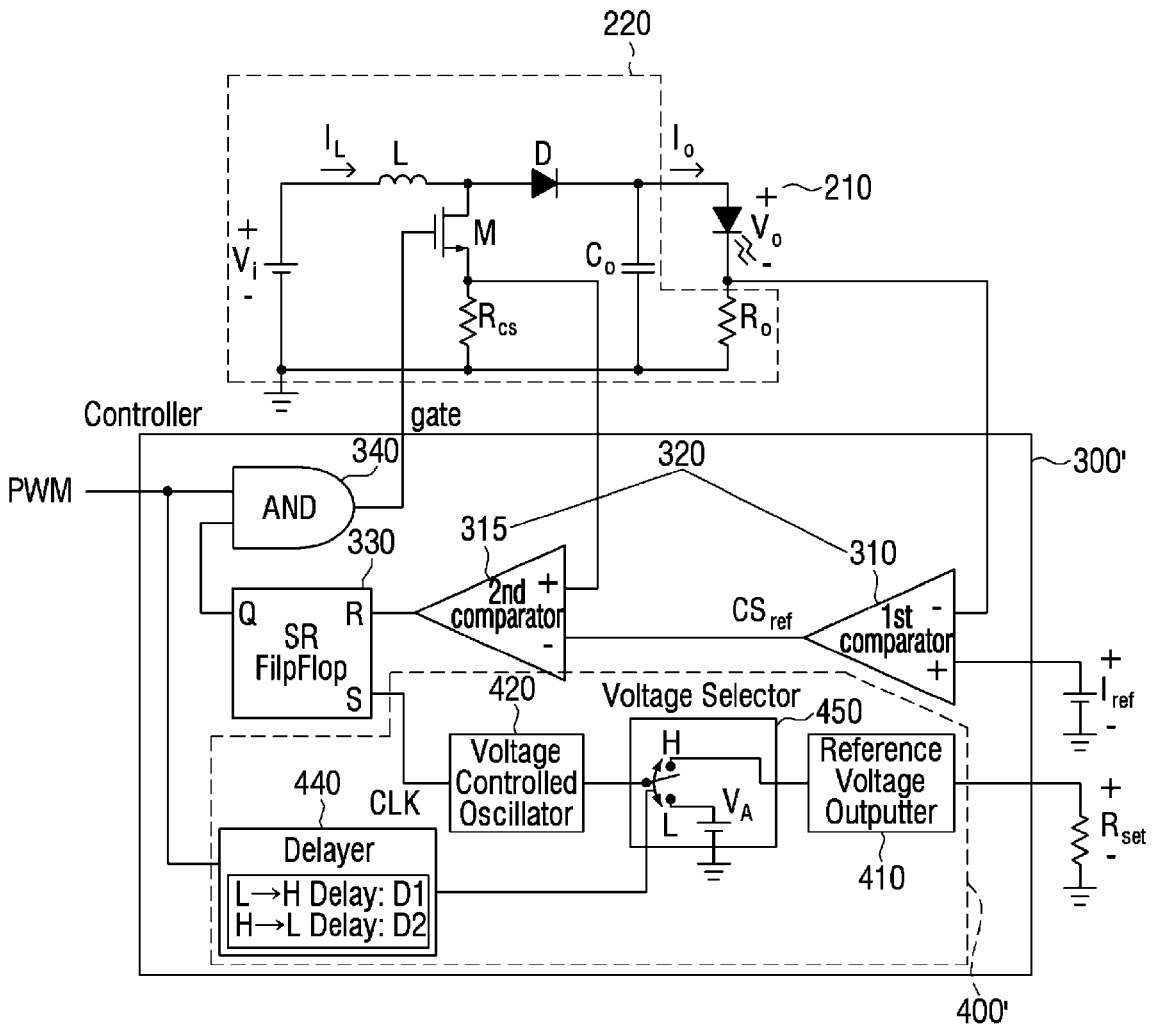
FIG. 15 is a diagram illustrating a driving controller according to another exemplary embodiment.

FIG. 15 is a block diagram illustrating another exemplary embodiment of a driving controller according to an exemplary embodiment.

Referring to FIG. 15, a driving controller 300' according to a second exemplary embodiment includes the comparator 320, the RS flip-flop 330, the AND gate 340, and a clock generator 400'. Since the comparator 320, the RS flip-flop 330, and the AND gate 340 have configurations similar to the ones described above with reference to FIG. 13, a repeated description thereof will be omitted for sake of brevity.

The clock generator 400' may include the reference voltage outputter 410, the voltage controlled oscillator 420, the delayer 440, and a voltage selector 450.

The reference voltage outputter 410 outputs the reference voltage corresponding to the first preset frequency. Specifically, the reference voltage outputter 410 may generate the reference voltage corresponding to the resistance value (specifically, the reference resistor) outside of the controller 300'.

The voltage controlled oscillator 420 generates the clock signal using the reference voltage. Specifically, if the voltage controlled oscillator 420 receives the reference voltage from the reference voltage outputter 410, the voltage controlled oscillator 420 may generate the first clock signal corresponding to the reference voltage. Conversely, if the voltage controlled oscillator 420 receives a second preset voltage (specifically, a voltage value corresponding to the second frequency) from the voltage selector 450 to be described below, the voltage controlled oscillator 420 may generate the second clock signal.

The delayer 440 delays the dimming signal by the preset time and provides the delayed dimming signal to the voltage selector 450.

The voltage selector 450 may bypass the reference voltage of the reference voltage outputter 410 to the voltage controlled oscillator 420 when the dimming signal has the high value, and may provide the second preset voltage to the voltage controlled oscillator 420 when the dimming signal has the low value.

Figure 16:
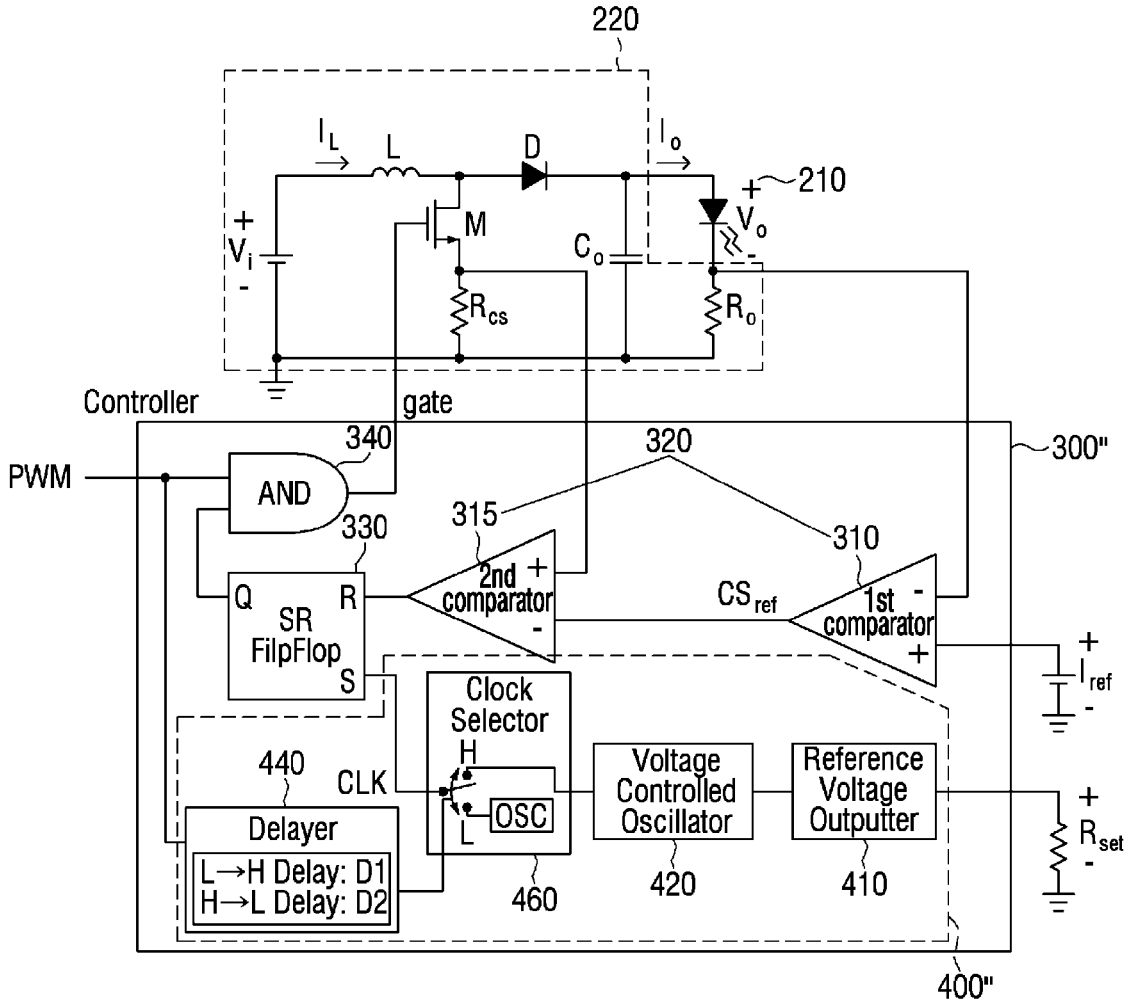
FIG. 16 is a diagram illustrating a driving controller according to yet another exemplary embodiment.

FIG. 16 is a block diagram illustrating a driving controller according to another exemplary embodiment.

Referring to FIG. 16, a driving controller 300", according to a third exemplary embodiment, includes the comparator 320, the RS flip-flop 330, the AND gate 340, and a clock generator 400". Since the comparator 320, the RS flip-flop 330, and the AND gate 340 have a configuration similar to the one described above with reference to FIG. 13, a repeated description will be omitted for sake of brevity.

The clock generator 400" may include the reference voltage outputter 410, the voltage controlled oscillator 420, the delayer 440, and a clock selector 460.

The reference voltage outputter 410 outputs the reference voltage corresponding to the first frequency preset. Specifically, the reference voltage outputter 410 may generate the reference voltage corresponding to the resistance value (specifically, the reference resistor) connected to a resistor outside of the controller 300".

The voltage controlled oscillator 420 generates the clock signal using the reference voltage output from the reference voltage outputter 410.

The delayer 440 delays the dimming signal by the preset time and provides the delayed dimming signal to the clock selector 460.

The clock selector 460 may bypass an output clock (i.e., the first clock) of the voltage controlled oscillator 420 to the RS flip-flop 330 when the dimming signal has the high value, and may provide an output of a second oscillator that generates the clock signal of the second preset frequency to the RS flip-flop 330 when the dimming signal has the low value.

Figure 17:
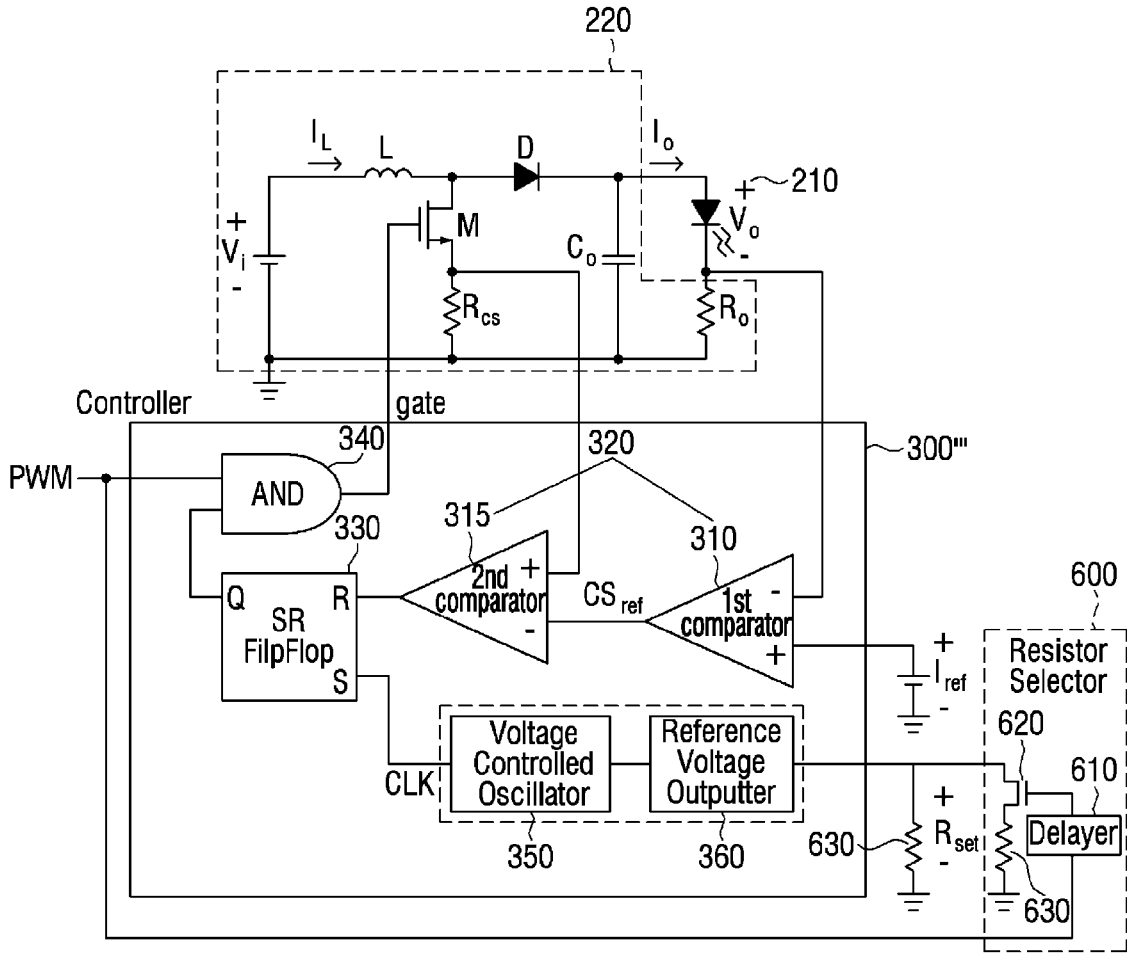
FIG. 17 is a diagram illustrating a driving controller according to yet another exemplary embodiment.

FIG. 17 is a block diagram illustrating a driving controller according to yet another exemplary embodiment.

Referring to FIG. 17, a driving controller 300'", according to a fourth exemplary embodiment, includes the comparator 320, the RS flip-flop 330, the AND gate 340, and a clock generator 400'". Since the comparator 320, the RS flip-flop 330, and the AND gate 340 have configuration analogous to the one described above with reference to FIG. 13, a repeated description will be omitted for sake of brevity.

The clock generator 400'" may include the reference voltage outputter 360, the voltage controlled oscillator 350, and a resistor selector 600.

The resistor selector 600 may selectively vary a resistance value connected to the reference voltage outputter 360 using a switch configuration and a resistor which is connected in series with the switch configuration. Specifically, the resistor selector 600 may connect a first resistor having a first resistance value corresponding to a first preset clock frequency to the reference voltage outputter 360 when the dimming signal has the high value, and may connect a second resistor having a second resistance value corresponding to a second preset frequency to the reference voltage outputter 360 when the dimming signal has the low value.

Although FIG. 17 illustrates an example in which the resistor selector varies the resistance value so that only one resistor is connected to the reference voltage outputter 360 or two resistors are connected in parallel to the reference voltage outputter 360 by a selectively connected switch, an exemplary embodiment is not limited thereto and is provided by way of an example only. The resistor selector may also be implemented in a form in which two resistors having different resistance values are selectively connected to the reference voltage outputter 360 according to a switching operation, in an exemplary embodiment.

Although FIG. 17 illustrates an example in which the delayer 610 delaying the dimming signal by the preset time is disposed in the resistor selector 600, the delayer 610 may be disposed outside of the resistor selector 600.

Further, FIG. 17 illustrates an example in which the resistor selector 600 is disposed outside the driving controller 300'", by way of an example only and not by way of a limitation. The resistor selector 600 may be disposed in the driving controller 300'", according to an exemplary embodiment. That is, it is possible to implement an operation of an exemplary embodiment by improving a system in a related art IC, and it is also possible to implement the same operation as that of an exemplary embodiment by adding only a configuration of the resistor selector 600 to a related art IC.

The reference voltage outputter 360 outputs the reference voltage corresponding to the connected resistance value.

The voltage controlled oscillator 350 generates the clock signal using the reference voltage output from the reference voltage output 360.

Figure 18:
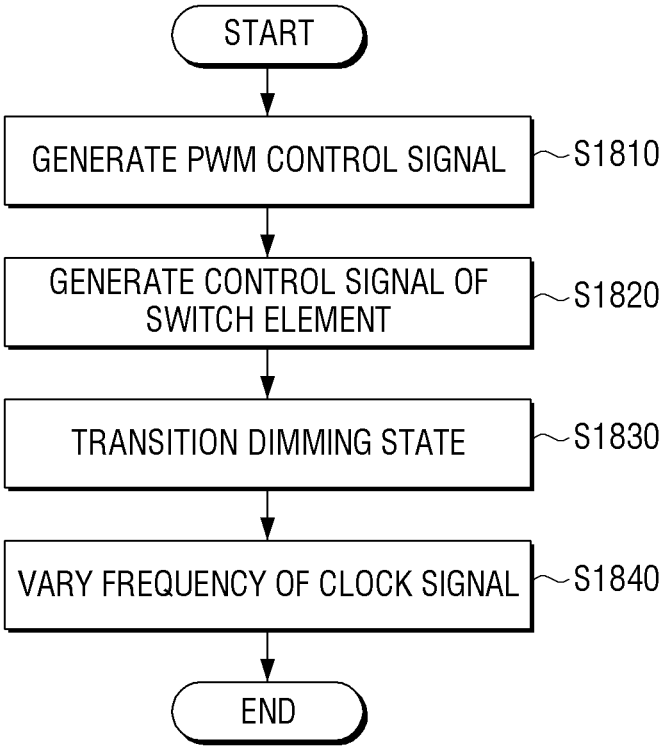
FIG. 18 is a flowchart illustrating a method of driving a light emitting diode according to an exemplary embodiment.

FIG. 18 is a flowchart illustrating a method of driving a light emitting diode of a light emitting diode driver circuit according to an exemplary embodiment.

Referring to FIG. 18, a PWM control signal is generated based on a value of current flowing in an LED array and a clock signal (in operation S1810). Specifically, a target current value may be generated by comparing the value of current flowing in the LED array with a preset current value, and the PWM control signal may be generated by comparing the generated target current value with a value of current flowing in an inductor.

In addition, a control signal for controlling a switch element is generated based on the generated PWM control signal and a dimming signal (in operation S1820). Specifically, the control signal of the switch element may be generated by performing an AND operation for the PWM control signal and the dimming signal.

In addition, if a signal value of the dimming signal is transitioned (in operation S1830), a frequency of the clock signal is varied (in operation S1840). Specifically, in a state in which the dimming signal is in an ON state, a first clock signal of a first frequency may be generated, and if the dimming signal is transitioned from the ON state to an OFF state, a second clock signal of a second frequency higher than the first frequency may be generated after a delay by a first preset time. In addition, if the dimming signal is again transitioned from the OFF state to the ON state, the first clock signal of the first frequency may be generated after a delay by a second preset time.

Therefore, in a method of driving a light emitting diode according to an exemplary embodiment, a clock frequency is varied according to the transition of the dimming signal, thereby making it possible to minimize a time difference between a timing at which the dimming signal is applied and a timing at which an LED driver circuit is operated. Accordingly, the same constant current is provided to the light emitting diode every period of the dimming signal, thereby making it possible to remove an LED flicker phenomenon. The method for driving a light emitting diode as illustrated in FIG. 18 may be executed on the display apparatus having the configuration of FIG. 1, or the LED driver circuit having the configuration of FIG. 3, or the driving controller having the configuration of FIGS. 13, 15, 16, and 17, and may also be executed on a display apparatus, an LED driver circuit, and a control IC having other configurations.

In addition, the method of driving a light emitting diode as described above may be implemented in a program including an executable algorithm which may be executed on a computer, and the program may be stored in a non-transitory computer readable medium.

The non-transitory computer readable medium does not mean a medium storing data for a short period such as a register, a cache, a memory, or the like, but means a machine-readable medium semi-permanently storing the data. Specifically, various applications or programs described above may be stored and provided in the non-transitory computer readable medium such as a compact disc (CD), a digital versatile disk (DVD), a hard disk, a Blu-ray disk, a universal serial bus (USB), a memory card, a read-only memory (ROM), or the like.

Although exemplary embodiments have been shown and described, it should be understood that the present disclosure is not limited to the disclosed exemplary embodiments and may be variously changed without departing from the spirit and the scope of the present disclosure. Accordingly, such modifications, additions and substitutions should also be understood to fall within the scope of the present disclosure.

What is claimed is:

1. A light emitting diode (LED) driver circuit, comprising:

an LED array;

an LED driving circuit configured to provide a constant current to the LED array by a switching operation; and a driving controller configured to control the LED driving circuit to provide the LED array with the constant current corresponding to a dimming signal by controlling the switching operation using a clock signal of a preset frequency, wherein the driving controller varies the preset frequency of the clock signal in response to a signal value of the dimming signal being transitioned.

2. The LED driver circuit as claimed in claim 1, wherein the driving controller is configured to use a first clock signal of a first frequency preset in response to the signal value of the dimming signal being a first value, and is configured to use a second clock signal of a second preset frequency higher than the first preset frequency in response to the signal value of the dimming signal being a second value lower than the first value.

3. The LED driver circuit as claimed in claim 1, wherein the driving controller is configured to vary the frequency of the clock signal after a preset period of time in response to the signal value of the dimming signal being transitioned.

4. The LED driver circuit as claimed in claim 3, wherein the driving controller is configured to use a first clock signal after a first preset time in response to the signal value of the dimming signal is being transitioned from a first value to a second value, which is higher than the first value, and is configured to use a second clock signal after a second preset time, which is longer than the first preset time, in response to the signal value of the dimming signal being transitioned from the second value to the first value.

5. The LED driver circuit as claimed in claim 4, wherein the first preset time is longer than one period of the first clock signal, and wherein the second preset time is longer than one period of the second clock signal.

6. The LED driver circuit as claimed in claim 3, wherein the driving controller is configured not to vary the clock signal in response to the dimming signal being transitioned before the preset time lapses.

7. The LED driver circuit as claimed in claim 1, wherein the driving controller comprises:

a clock generator configured to generate a clock signal of a preset frequency;

a switching element configured to perform the switching operation;

a comparator configured to sense whether or not a current flowing in the switch element is greater than or equal to a preset current;

an RS flip-flop configured to receive the clock signal as a set signal and to receive an output of the comparator as a reset signal; and an AND gate configured to perform an AND operation of an output of the RS flip-flop and the dimming signal and configured to provide the result of the AND operation to the switching element.

8. The LED driver circuit as claimed in claim 7, wherein the clock generator comprises:

a reference voltage outputter configured to output a reference voltage corresponding to a first preset frequency;

a voltage controlled oscillator configured to generate the clock signal using the reference voltage;

a gain configured to bypass the reference voltage to the voltage controlled oscillator in response to the signal value of the dimming signal being a first value, and multiply a preset gain value with the reference voltage and provide the result to the voltage controlled oscillator in response to the signal value of the dimming signal being a second value lower than the first value; and a delayer configured to delay the dimming signal by a preset time and provide the delayed dimming signal to the gain.

9. The LED driver circuit as claimed in claim 8, wherein the delayer comprises:

a first resistor configured to receive the dimming signal through a first end thereof;

a first diode configured to have an anode connected to a second end of the first resistor;

a second resistor configured to be connected to said first end of the first resistor and configured to receive the dimming signal;

a second diode configured to have a cathode connected to the second end of the second resistor; and a capacitor configured to be commonly connected to a cathode of the first diode and an anode of the second diode.

10. The LED driver circuit as claimed in claim 9, wherein a first resistance value of the first resistor and a second resistance value of the second resistor are different from each other.

11. The LED driver circuit as claimed in claim 7, wherein the clock generator comprises:

a reference voltage outputter configured to output a reference voltage corresponding to a first preset clock frequency;

a voltage controlled oscillator configured to generate the clock signal using the reference voltage;

a voltage selector configured to bypass the reference voltage to the voltage controlled oscillator in response to the signal value of the dimming signal being a first value, and to provide a second reference voltage corresponding to a second preset frequency to the voltage controlled oscillator in response to the signal value of the dimming signal being a second value lower than the first value; and a delayer configured to delay the dimming signal by a preset time and to provide the delayed dimming signal to the voltage selector.

12. The LED driver circuit as claimed in claim 7, wherein the clock generator comprises:

a reference voltage outputter configured to output a reference voltage corresponding to a first preset frequency;

a voltage controlled oscillator configured to generate the clock signal using the reference voltage;

a clock selector configured to bypass and output the clock signal generated by the voltage controlled oscillator to the RS flip-flop in response to the signal value of the dimming signal being a first value, and to provide an output of a second oscillator generating a second clock signal of a second preset frequency to the RS flip-flop in response to the signal value of the dimming signal being a second value lower than the first value; and a delayer configured to delay the dimming signal by a preset time and to provide the delayed dimming signal to the clock selector.

13. The LED driver circuit as claimed in claim 7, wherein the clock generator comprises:

a reference voltage outputter configured to output a reference voltage corresponding to a resistance value of a connected resistor;

a voltage controlled oscillator configured to generate the clock signal using the reference voltage and provide the generated clock signal to the RS flip-flop;

a resistor selector configured to connect a first resistor having a first resistance value corresponding to a first preset clock frequency to the reference voltage output in response to the signal value of the dimming signal being a first value, and connect a second resistor having a second resistance value corresponding to a second preset frequency to the reference voltage output in response to the signal value of the dimming signal being a second value lower than the first value; and a delayer configured to delay the dimming signal by a preset time and to provide the delayed dimming signal to the resistor selector.

14. The LED driver circuit as claimed in claim 1, wherein the LED driving circuit comprises:

a power source configured to provide power;

a switching element configured to perform the switching operation;

an inductor configured to have a first end connected to the power source and a second end connected to a first end of the switching element;

a first resistor configured to have a first end connected to a second end of the switch element and a second end connected to a ground terminal of the power source;

a diode configured to have an anode commonly connected to the second end of the inductor and the first end of the switching element, and a cathode connected to a first end of the LED array;

a capacitor configured to have a first end commonly connected to the cathode of the diode and the first end of the LED array, and a second end connected to the ground terminal of the power source; and a second resistor configured to have a first end connected to a second end of the LED array and a second end connected to the ground terminal of the power source.

15. A display apparatus comprising:

a liquid crystal display (LCD) panel configured to receive an image signal and display an image;

a backlight comprising a light emitting diode (LED) array and configured to provide a constant current corresponding to a dimming signal to the LED array to provide light having brightness corresponding to the dimming signal to the LCD panel; and an image signal provider configured to provide the image signal to the LCD panel, to generate the dimming signal corresponding to the image signal, and to provide the generated dimming signal to the backlight, wherein the backlight controls the constant current provided to the LED array using a clock signal of a preset frequency, and varies the preset frequency of the clock signal in response to a signal value of the dimming signal being transitioned.

16. The display apparatus as claimed in claim 15, wherein the backlight comprises:

an LED array;

an LED driving circuit configured to provide a constant current to the LED array by a switching operation; and a driving controller configured to control the LED driving circuit to provide the LED array with constant current corresponding to a dimming signal by controlling the switching operation using the clock signal of the preset frequency, and to vary the preset frequency of the clock signal in response to the signal value of the dimming signal being transitioned.

17. The display apparatus as claimed in claim 16, wherein the driving controller is configured to use a first clock signal of a first preset frequency in response to the signal value of the dimming signal being a first value, and to use a second clock signal of a second frequency higher than the first frequency in response to the signal value of the dimming signal being a second value lower than the first value.

18. A method of driving a light emitting diode (LED) of an LED driver circuit, the method comprising:

generating a pulse width modulated (PWM) control signal based on a value of current flowing in an LED array and a clock signal;

generating a control signal for controlling a switching operation based on the generated PWM control signal and a dimming signal; and varying a frequency of the clock signal in response to a signal value of the dimming signal being transitioned.

19. The method as claimed in claim 18, wherein the varying the frequency of the clock signal comprises:

in response to the signal value of the dimming signal being transitioned from a first value to a second value lower than the first value, varying the clock signal from a first clock signal of a first preset frequency to a second clock signal higher than the first preset frequency, and in response to the signal value of the dimming signal being transitioned from the second value to the first value, varying the clock signal from the second clock signal to the first clock signal.

20. The method as claimed in claim 18, wherein the generating the PWM control signal comprises generating the PWM control signal using the varied clock signal after a preset time, in response to the signal value of the dimming signal being transitioned.

* * * * *